US009418807B2

(12) United States Patent
Marlin et al.

(10) Patent No.: US 9,418,807 B2
(45) Date of Patent: Aug. 16, 2016

(54) ELECTRICAL SWITCH FORMING A FAST-ACTING CIRCUIT BREAKER

(71) Applicant: HERAKLES, Le Haillan (FR)

(72) Inventors: Frederic Marlin, Saint Medard en Jalles (FR); Romain Lorenzon, Eysines (FR)

(73) Assignee: HERAKLES, Le Haillan (FR)

( * ) Notice: Subject to any disclaimer, the term of this patent is extended or adjusted under 35 U.S.C. 154(b) by 0 days.

(21) Appl. No.: 14/411,840

(22) PCT Filed: Jun. 26, 2013

(86) PCT No.: PCT/FR2013/051486
§ 371 (c)(1),
(2) Date: Dec. 29, 2014

(87) PCT Pub. No.: WO2014/001713
PCT Pub. Date: Jan. 3, 2014

(65) Prior Publication Data

US 2015/0206681 A1 Jul. 23, 2015

(30) Foreign Application Priority Data

Jun. 29, 2012 (FR) ..... 12 56248

(51) Int. Cl.
*H01H 3/24* (2006.01)
*H01H 35/24* (2006.01)
(Continued)

(52) U.S. Cl.
CPC ..... *H01H 39/00* (2013.01); *H01H 1/06* (2013.01); *H01H 1/365* (2013.01); *H01H 39/004* (2013.01)

(58) Field of Classification Search
CPC ..... H01H 39/00; H01H 39/004; H01H 9/10; H01H 9/32; H01H 9/16; H01H 1/365; H01H 85/0445; H01H 71/12; H01H 71/123; H01H 83/20; H01H 3/12; H01H 3/02; H01H 15/00; H01H 15/08; H01H 15/10; H01H 15/16; H01H 2003/00; H01H 205/00; H01H 2221/00; H01H 2221/014; H01H 3/24; H01H 35/24; H01H 35/38; B60R 16/04
See application file for complete search history.

(56) References Cited

U.S. PATENT DOCUMENTS 5,018,991 A * 5/1991 Katz ..... H01H 85/201 337/205
5,783,987 A * 7/1998 Kern ..... H01H 39/00 337/4
2003/0231438 A1* 12/2003 Slade ..... H01H 33/32 361/2

FOREIGN PATENT DOCUMENTS

DE 202005014042 12/2005
EP 0690466 1/1996

(Continued)

*Primary Examiner* — Renee Luebke
*Assistant Examiner* — Anthony R. Jimenez
(74) *Attorney, Agent, or Firm* — Hamre, Schumann, Mueller & Larson, P.C.

(57) ABSTRACT

A normally closed electric switch having a sliding assembly that is actuated to open the switch, e.g. by a pyrotechnic gas generator. Prior to actuation, a conductive portion of the sliding assembly (21) is in tight contact with two rings (13*a*, 14*a*) that are axially offset on the same axis, belonging respectively to two electrically conductive tabs (13, 14), and after the actuator has been triggered, the upstream tab (13) is separated from the conductive portion of the sliding assembly. According to the invention, sliding assembly comprises a tube split by a slot extending along its entire length, and the conductive portion of the sliding assembly is constituted by all or part of said split tube, the clamping force between the conductive portion and the primary electrically conductive tabs being provided by the resilience of the split tube.

13 Claims, 5 Drawing Sheets

(51) Int. Cl.

| | |
|---|---|
| ***H01H 35/38*** | (2006.01) |
| ***H01H 39/00*** | (2006.01) |
| ***H01H 1/36*** | (2006.01) |
| ***H01H 1/06*** | (2006.01) |

(56) References Cited

FOREIGN PATENT DOCUMENTS

| | | |
|---|---|---|
| FR | 2953322 | 6/2011 |
| WO | WO 97/37873 | 10/1997 |

* cited by examiner

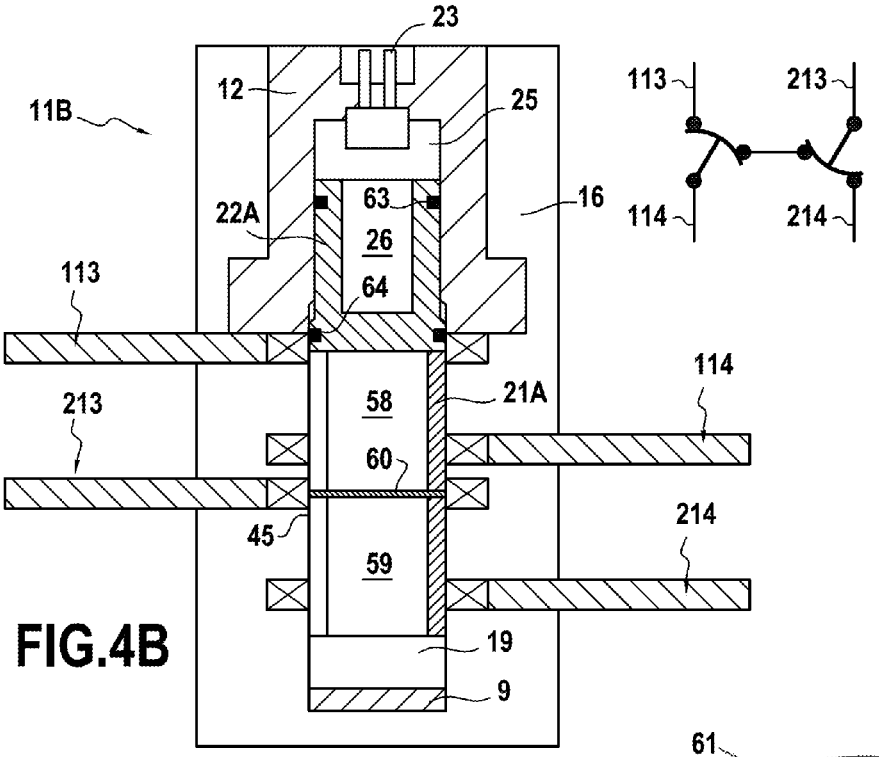
FIG.4B
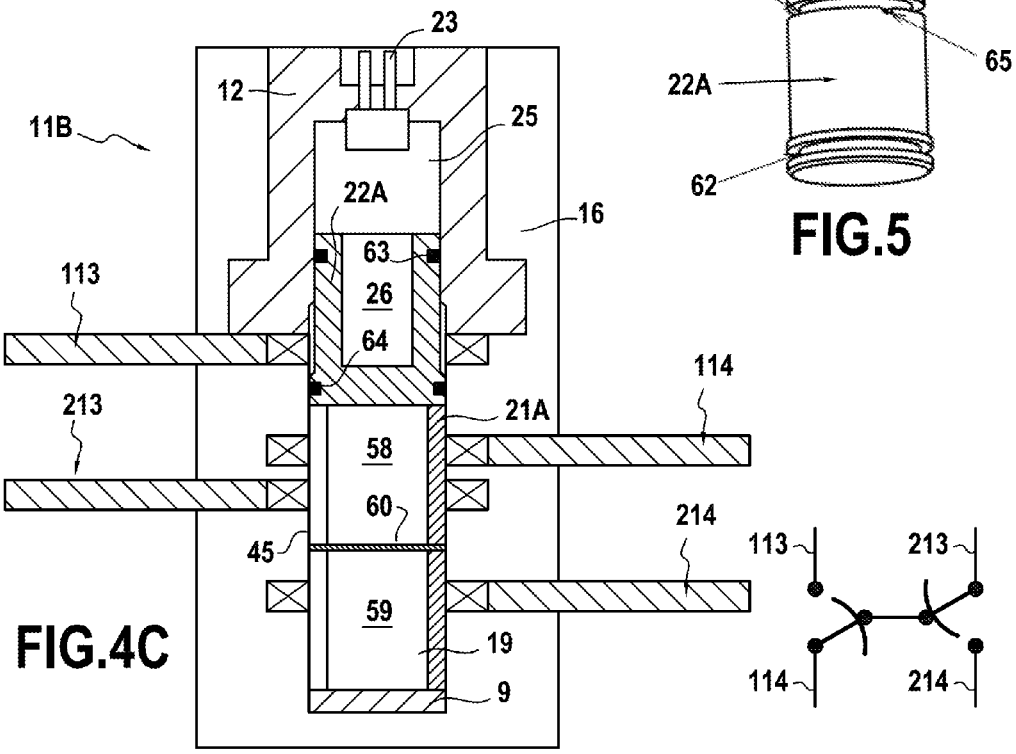
FIG.5
FIG.4C

ELECTRICAL SWITCH FORMING A FAST-ACTING CIRCUIT BREAKER

BACKGROUND

In numerous applications, it is necessary to have electric switches that are fast and reliable that make it possible to open a faulty circuit in order to isolate one or more components, in particular when they have failed, and also making it possible, where appropriate, to act simultaneously to close a branch circuit.

Document FR 2 953 322 describes an example of an electric switch of the above-specified type in which electrical contact between the sliding assembly and the conductive tabs takes place via tightly-engaged rings, either because the rings are split rings, thereby imparting a certain amount of resilience to the electrical connection, or else because the sliding assembly is engaged in the rings by forced engagement. Nevertheless, in the long run split rings lose their shape and tend to become oval under the effect of stresses relaxing. Under such circumstances, the electrical contact between the rings and the sliding assembly can become uncertain or might even be lost. As for mounting the sliding assembly by force between the annular rings of the conductive tabs, that can turn out to be difficult.

SUMMARY

The present invention relates to an electric switch acting in particular as a circuit breaker. More particularly, the invention relates to an electric switch having a sliding assembly, and in particular an electric switch of the type comprising a hollow body defining a cavity, a sliding assembly comprising at least one conductive portion and adapted to move in said cavity from an "initial" first position to a second position, an actuator arranged to co-operate with said sliding assembly and to move it in said cavity, and at least two primary electrically conductive tabs, respectively an upstream tab and a downstream tab, each comprising a ring penetrating into said cavity, said rings being on the same axis and being offset axially in the travel direction of the sliding assembly, wherein the conductive portion of the sliding assembly is in at least tight electrical contact with the two primary electrically conductive tabs when the sliding assembly is in its first position, and when the sliding assembly is in its second position, the upstream electrically conductive tab is separated from the conductive portion of said sliding assembly.

The electric switch of the present description is used mainly as a circuit breaker, and it can also be used as an electric changeover switch. It is particularly suitable for high-current electrical circuits.

Throughout the present description, the term "primary electrically conductive tab" is used to designate electrically conductive tabs that are connected to the conductive portion of the sliding assembly while it is in its first position, i.e. while the electric switch is in its initial state.

In contrast, the term "secondary electrically conductive tab" is used to designate electrically conductive tabs that are connected to the conductive portion of the sliding assembly only after it has moved into its second position (as when a component of the first electrical circuit has been isolated, e.g. because it is considered to have failed, and a second electrical circuit has been closed).

An object of the present invention is to propose an electric switch that avoids the above-mentioned drawbacks.

In particular, an object of the present invention is to propose an electric switch of the above-specified type that is capable of being assembled very simply, that can respond in a very short period of time, and that provides electrical connections that are reliable over time.

More precisely, the invention provides an electric switch comprising a hollow body defining a cavity, a sliding assembly comprising at least one conductive portion and adapted to move in said cavity from an "initial" first position to a second position, an actuator arranged to co-operate with said sliding assembly and to move it in said cavity, and at least two primary electrically conductive tabs, respectively an upstream tab and a downstream tab, each comprising a ring penetrating into said cavity, said rings being on the same axis and being offset axially in the travel direction of the sliding assembly, wherein the conductive portion of the sliding assembly is connected by a clamping force with the two primary electrically conductive tabs when the sliding assembly is in its first position, and when the sliding assembly is in its second position, the upstream electrically conductive tab is separated from the conductive portion of said sliding assembly, said switch being characterized in that the sliding assembly comprises at least one tube split by a slot extending along its entire length, and in that the conductive portion of the sliding assembly is constituted by all or part of said split tube, the clamping force between the conductive portion and the primary electrically conductive tabs being provided by the resilience of the split tube.

In the above definition, the terms "upstream" and "downstream" are used to designate the position of one element relative to another while using as a reference the travel direction of the sliding assembly when it is actuated.

By means of the above provisions, the electrical circuit connecting together the primary electrically conductive tabs is closed by electrical contacts that are reliable, so long as the electric switch is in its initial position. Since the connection between the primary electrically conductive tabs and the conductive portion of the sliding assembly is a permanent electrical junction obtained by construction by the initial clamping of the split tube, the electrical contact between those elements is well controlled and does not degrade over time, even if the electric switch is subjected to vibration or to impacts. Undesirable phenomena such as intermittent contact, Joule effect losses, electric arcs, etc., are avoided. When, under drive from the actuator, the sliding assembly goes from its first position to its second position, at least one of the tabs is no longer electrically connected to the conductive portion of the sliding assembly. The electrical connection between the two primary electrically conductive tabs is broken, and the electrical circuit is open.

The slot gives the split tube resilience that makes it easier to set up the electrical junction. The split tube can thus be engaged as a force fit between the rings of the electrically conductive tabs.

The term "force fit" is used in particular to designate a substantially radial force being applied against the longitudinally free ends of the tube so as to move those ends towards each other and reduce the radial size of the tube, and then once the tube has been inserted between the rings, its ends are released so that under the effect of the elastic resilience of the tube, it presses against the inside faces of the rings.

With such a split tube, any relaxing of stress leads to an increase in the diameter of the tube and thus contributes to improving electrical contact and during assembly within the ring, it is limited by the inside diameter of the ring.

The resilience of the split tube provides a clamping force that is strong enough to ensure that electrical resistance is very low, while nevertheless limiting the force required for moving the split tube when the switch is operated.

In practice, the tight force may be determined by selecting a split tube that has a rest diameter that is about 4% to 5% greater than the inside diameter of the ring that is to receive said tube, and by assembling the split tube in the ring by making use of the elasticity of the material constituting the tube. Under such conditions, it is possible to obtain contact resistances of the order of 30 microohms (μΩ) to 50μΩ.

In more general manner, it is possible to adjust the clamping force by acting on:

the clamping clearance between the diameter of the rings in the conductive tabs and the outside diameter at rest of the split tube, and in particular the initial stress applied to the split tube when moving together the two free ends of the tube that define the slot;

the thickness of the split tube (whether the length of the tube is a function of the desired movement, for reasons associated with maximum voltage); and the nature of the materials.

The fact of having a clamping force that is orthogonal to the travel axis made available by construction makes it possible to reduce the force needed for moving the split tube.

Furthermore, the resistance to movement of the split tube inside the cavity varies little with varying magnitude of the clamping between the rings and the split tube.

It should be observed that the split tube can be obtained very simply, starting from a standard tube and then splitting it by a simple milling or cutting operation.

In the present invention, it is preferred to use annular rings that are continuous (i.e. that are not slit radially). Such rings may be obtained easily by punching or stamping using industrial techniques with satisfactory tolerances and without any risk of losing shape by relaxing stresses (as would happen with split rings since they generally become oval in the vicinity of the slot).

In an embodiment of the invention, the slot extends in the axial direction of the tube.

Advantageously, the width of the slot made in the tube may be selected to compensate at most for the difference in diameter between the conductive tabs and said split tube, the diameter of the tube being greater prior to force assembly than the diameter of the rings of the conductive tabs.

In an embodiment, the sliding assembly includes an additional clamping element inserted inside the split tube and configured to apply an outwardly directed radial clamping force on the tube towards the electrically conductive tabs. Preferably, the additional clamping element is made of insulating material.

In an embodiment, the actuator is a pyrotechnic gas generator (e.g. a micro gas generator and its pyrotechnic initiator, or a pyrotechnic initiator) and the sliding assembly includes a piston movable inside said cavity, a gas expansion chamber being defined between said pyrotechnic gas generator and said piston. In preferred manner, the piston is made of insulating material.

In an embodiment, the piston includes at least one circumferential groove adapted to receive a sealing ring.

In an embodiment, the piston is made of insulating material and comprises a first portion adapted to slide along the cavity, and a second portion that is situated in line with the first portion and that is suitable for being inserted, at least in part, inside the split tube in order to constitute a guide element for said tube.

In an embodiment, the second portion is mounted by force inside the split tube. The guide element thus has an additional function of forcing the split tube to open radially, thereby reinforcing its electrical connection with the rings of the conductive tabs.

In an embodiment, the piston presents a cavity that is axially open upstream, the space defined by said cavity constituting at least a portion of the gas expansion chamber.

In an embodiment, the switch includes at least one secondary electrically conductive tab arranged downstream from said first and second primary electrically conductive tabs, and wherein the stroke of the sliding assembly is such that when it is in said second position, said second primary electrically conductive tab is electrically connected to said secondary electrically conductive tab by said conductive portion of the sliding assembly.

The above-defined structure is favorable to extending the number of circuit breakers and/or changeover switches. On these lines, and in a possible variant, the switch is characterized in that at least two groups of two primary conductive tabs arranged in line one with another from upstream to downstream and in that said sliding assembly includes a corresponding number of conductive portions that are mutually electrically insulated, each of said conductive portions interconnecting only the conductive tabs of each group when said sliding assembly is in its initial position.

It should be observed that in above-described variant, the upstream primary conductive tab of a group of two primary conductive tabs situated downstream from another tab may act as a secondary conductive tab relative to that group.

In this same type of embodiment having a plurality of primary conductive tab groups, it is also possible to ensure that the arrangement of said sliding assembly and of the conductive tabs of the two groups is such that for an intermediate position of said sliding assembly, the electrically conductive tabs of the two groups are electrically interconnected via said conductive portions.

For example, in order to obtain this result, said two conductive portions may be separated by insulation of thickness that is smaller than the thickness of a conductive tab, so that at a given moment of the stroke, the two conductive portions of the sliding assembly are electrically connected together by the thickness of a ring of one of the conductive tabs. This transient position makes it possible, for example, to close a branch circuit momentarily so as to ensure continuity of an electrical circuit during the travel of the sliding assembly.

In an embodiment, the cavity in the hollow body is terminated in its downstream end by a guide portion for guiding the sliding assembly when it goes from its first position to its second position. The guide portion serves to position the conductive sliding split tube appropriately when it is in its second position. When, in this second position, the electric switch is to close one or more branch circuits, the guide portion serves to ensure reliable electrical contact of good quality between certain electrically conductive tabs and the conductive portion(s) of the sliding assembly.

BRIEF DESCRIPTION OF THE DRAWINGS

The invention can be better understood and other advantages therefore appear more clearly in the light of the following description of embodiments of an electric switch in accordance with the principle of the invention, given purely as examples and described with reference to the accompanying drawings, in which:

FIGS. 4A to 4C are views similar to FIGS. 3A to 3C showing yet another variant; and FIG. 5 shows yet another variant piston suitable for use with the present invention.

DETAILED DESCRIPTION

Figure 1A:
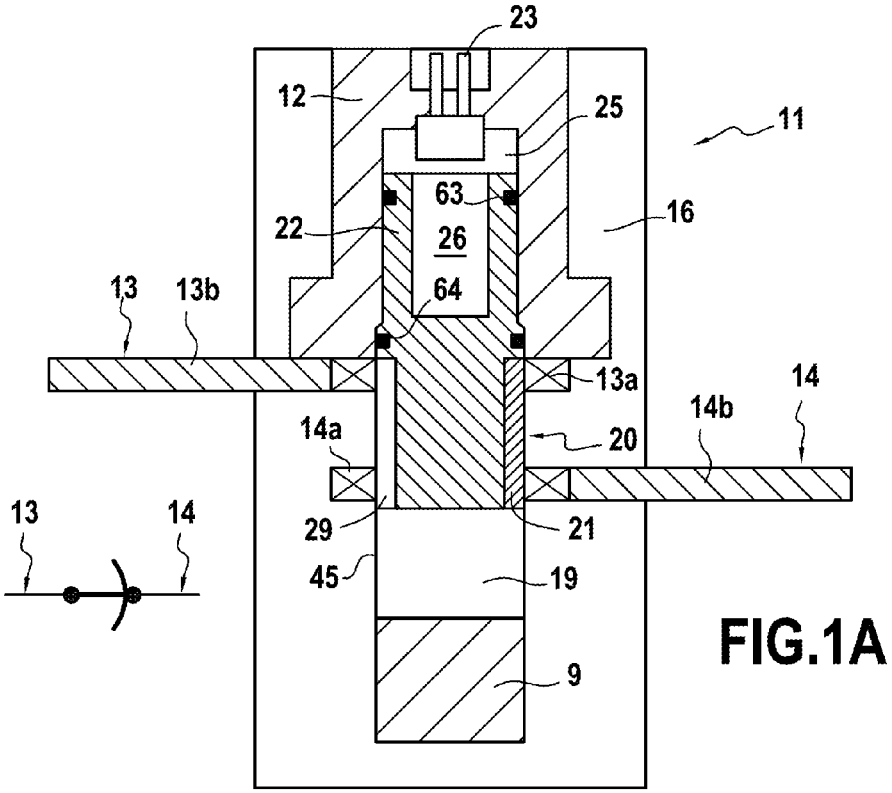
FIGS. 1A and 1B are diagrammatic longitudinal section views showing the structure and the operation of an electric switch forming a circuit breaker.
Figure 1B:
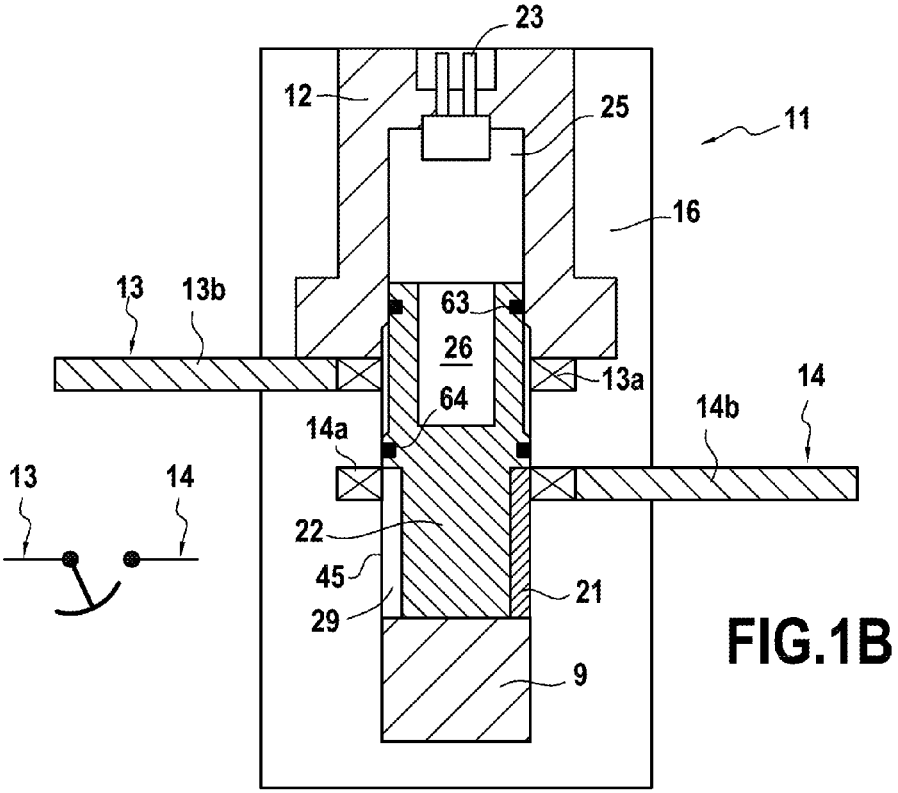
Figure 2:
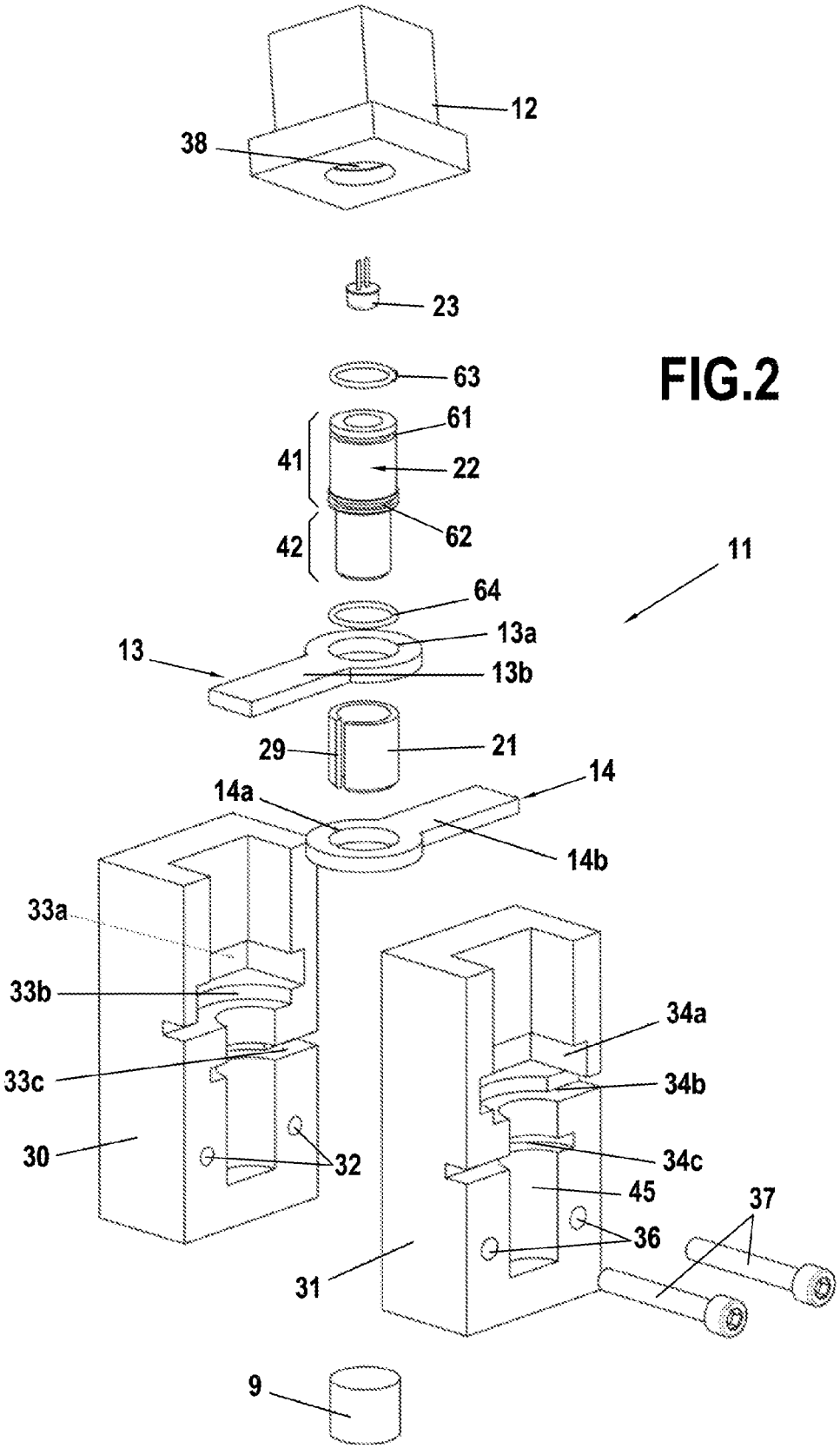
FIG. 2 is an exploded perspective view of one possible technological embodiment of an electric switch as shown in FIGS. 1A and 1B.

With reference more particularly to FIGS. 1 and 2, there can be seen a first embodiment of an electric switch 11 in accordance with the invention and in this example constituting more particularly a circuit breaker for any electrical circuit connected to two primary electrically conductive tabs 13 and 14 in the meaning as defined above.

The circuit breaker switch 11 has a hollow body 16 of electrically insulating material defining a cavity 19, an actuator 23, and the two primary electrically conductive tabs 13 and 14 projecting into the cavity 19.

The electric switch 11 also has a sliding assembly 20 suitable for being moved inside the cavity. In the example shown, the cavity 19 is cylindrical and the sliding assembly 20 is itself essentially cylindrical.

The sliding assembly 20 comprises a split tube 21 having at least one conductive portion. In the example shown in FIGS. 1 and 2, the split tube 21 is entirely conductive.

The sliding assembly 20 also has a slide 22 of insulating material forming a kind of piston and adapted to move inside the cavity so as to entrain the split tube 21 therewith.

In the example shown, the actuator 23 is a pyrotechnic gas generator of conventional type installed in the hollow body so as to communicate with the cavity 19.

A gas expansion chamber 25 is defined between the pyrotechnic gas generator 23 and one of the axial end faces of the piston 22. More particularly, in the example shown, the piston 22 has a cavity 26 in its upstream face that faces towards the gas generator 23, and the cavity 26 constitutes a portion of the gas expansion chamber 25.

In the initial position in which the slide 22 is practically in contact with the actuator 23, i.e. with the expansion chamber 25 reduced to its minimum volume, the two electrically conductive tabs 13 and 14 are electrically connected together via the split tube 21 in a first position referred to as an "initial" position. Electrical contact is established via the conductive portion of the split tube 21, i.e. the entire tube in this example.

As shown, the split tube 21 moves towards a second position in the cavity (FIG. 1B) under the effect of the actuator 23, i.e. when the pyrotechnic gas generator is fired, and under such circumstances, the electrical connection between the two conductive tabs 13 and 14 is broken such that the upstream primary electrical conductive tab 13 is separated from the split tube 21.

According to a remarkable characteristic of the invention, the two conductive tabs comprise two rings 13*a* and 14*a* on the same axis that are axially offset along the travel direction of the sliding assembly 20, and these rings 13*a* and 14*a* are at least in tight contact with the conductive portion of the sliding assembly (in this example the split tube 21) when it is in said first position. In this example, the inside faces of the rings 13*a* and 14*a* are flush with the wall of the cavity 19. When the sliding assembly is in its second position, the ring 13*a* is separate from the conductive portion of the sliding assembly (i.e. the split tube 21).

Advantageously, in said first position, the split tube 21 is engaged as a force fit between the rings 13*a* and 14*a* of said primary conductive tabs 13 and 14, thereby guaranteeing excellent electrical connection between said primary conductive tabs throughout the period prior to actuating the electric switch 11.

FIG. 2 shows how it is possible in simple and inexpensive manner to make an electric switch in accordance with the above-described circuit breaker.

The hollow body 16 is defined by assembling together two housing elements 30 and 31, respectively a left element 30 and a right element 31.

The housing element 30 includes two tapped blind holes 32 surmounted by a laterally open indentation 33 of shape that is defined to receive a portion of each electrically conductive tab 13, 14 and a portion of a gas generator support 12.

Each electrically conductive tab has a ring 13*a*, 14*a* extended laterally by a connection bar 13*b*, 14*b* that projects outside the insulating hollow body so as to be capable of being connected to the electrical circuit external to the circuit breaker.

The second housing element 31 has two through holes 36 enabling fastener bolts 37 to be inserted. In the same manner as the first housing element 30, it likewise has a laterally open indentation 34 of shape that is defined to receive a portion of each electrically conductive tab 13, 14 and a portion of the gas generator support 12.

The gas generator support 12 is mounted between the two housing elements 30, 31 and has a hole 38 that receives the gas generator 23 at its end. The gas generator 23 is mounted inside said support 12 so as to define the gas expansion chamber 25 inside said hole 38.

As mentioned above, the split tube 21 is engaged by force in each of the two rings 13*a* and 14*a*.

In this manner, in said first or "initial" position, the two rings 13*a* and 14*a* that are axially offset on the same axis are electrically interconnected by the split metal tube 21.

In the example shown, the slide 22 is inserted inside the sliding split tube 21. The slide 22 thus performs the following functions:

A first portion or upstream portion 41 of cylindrical shape and of diameter substantially equal to the diameter of the cavity 19 slides along the inside face of said cavity.

In its upstream face that faces upwards in FIGS. 1 and 2, the first portion 41 includes a cavity 26, in this example likewise substantially cylindrical, that defines a portion of the initial volume of the expansion chamber 25.

As can be seen in FIG. 2, the first portion 41 has two circumferential grooves 61 and 62 that are axially spaced apart from each other, each receiving a sealing O-ring 63, 64. Thus, the piston 22 closes the gas expansion chamber 25 and enables pressure to rise quickly in the closed environment of this chamber. The gas generated in the gas expansion chamber 25 is prevented from infiltrating towards the conductive rings 13*a* and 14*a*.

A notch 65 is advantageously formed in at least one of said grooves and configured to form a calibrated passage for allowing air to escape from the gas expansion chamber while the piston 22 is being mounted in the gas generator support 12.

The piston 22, which is situated at least in part upstream from the split tube, has the function of transmitting to said tube 21 the pressure force generated by the gas in the gas expansion chamber 25 so as to enable the circuit to be broken by moving said tube 21.

This first portion 41 is extended downstream by a second portion 42 of slightly smaller diameter that is selected to enable it to be inserted, possibly as a force fit, inside the split tube once the split tube has been inserted between the rings 13*a* and 14*a*.

This second portion may act as a guide element for the split tube while it is moving inside the cavity 19.

In an advantageous embodiment, it may also form an additional clamping element for pressing the split tube against the rings 13*a* and 14*a*.

After the pyrotechnic gas generator 23 has been triggered, the situation is as shown in FIG. 1B. The electrical connection between the two tabs 13 and 14 has been interrupted.

It should be observed that in this example the piston 22 presents on a portion situated directly upstream from the split tube a diameter that is equal at most to the outside diameter of the tube once inserted between the rings. In the example shown, the diameter of the upstream portion of the piston is even slightly smaller than that of the split tube, such that on entraining the split tube the piston can slide easily between the rings without remaining jammed between them. This is made possible in this example by a small difference in diameter between the furthest upstream portion of the cavity along which the piston slides (formed in this example by the bore of the generator support) and its downstream portion (formed by the housing elements), which is larger and into which the rings project.

As can be seen in the drawings, the cavity 19 is extended downstream by a guide portion 45 that serves to guide the split tube 21 when it passes from the first position to the second position, and serves to ensure that it follows a straight path.

A damper pad 9 is inserted in the end of the cavity 19. Where necessary, this damper pad 9 has the function of reducing the impact energy from the conductive split tube 21 and the insulating piston 22 when these two parts come into contact with the end of the switch body 16.

Figure 3A:
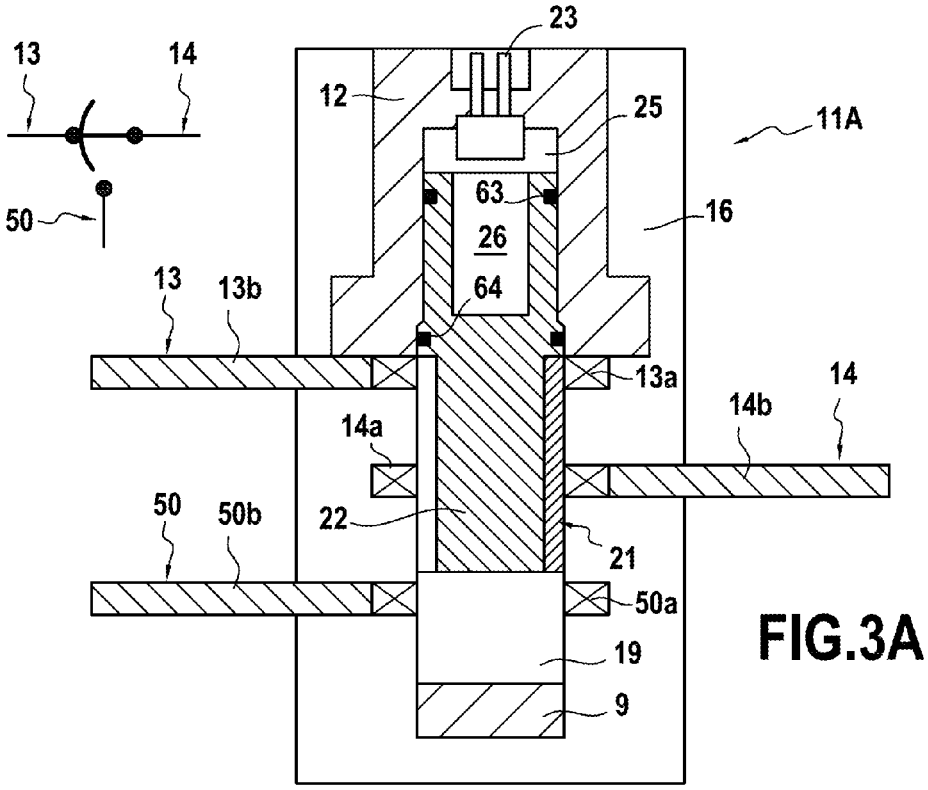
FIGS. 3A to 3C are diagrammatic views showing the structure and the operation of another embodiment.
Figure 3B:
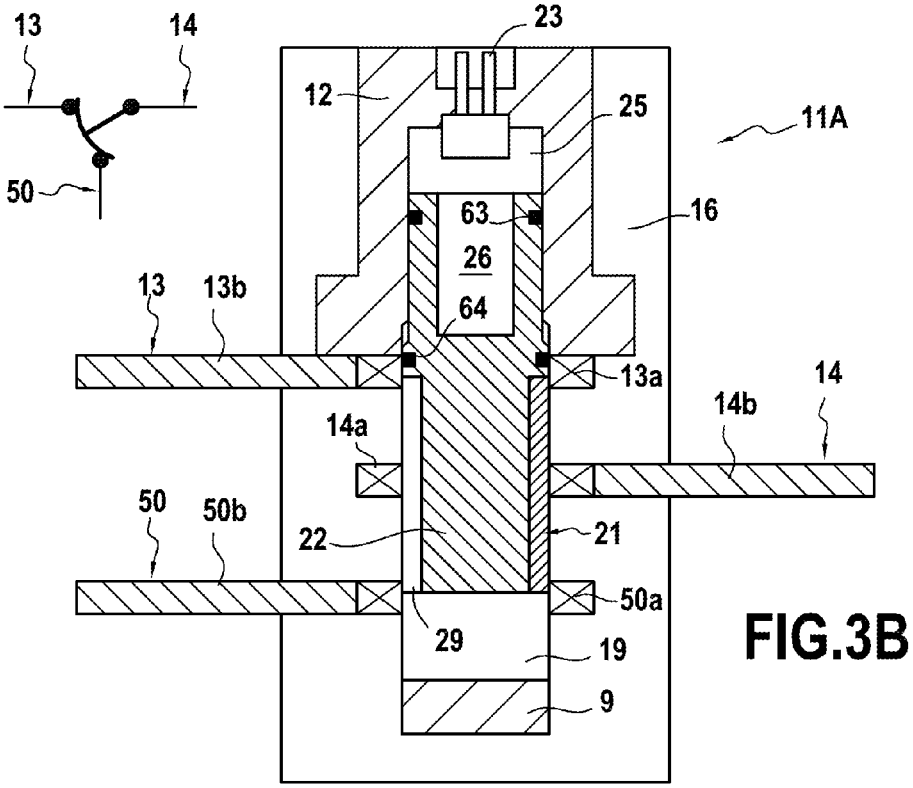
Figure 3C:
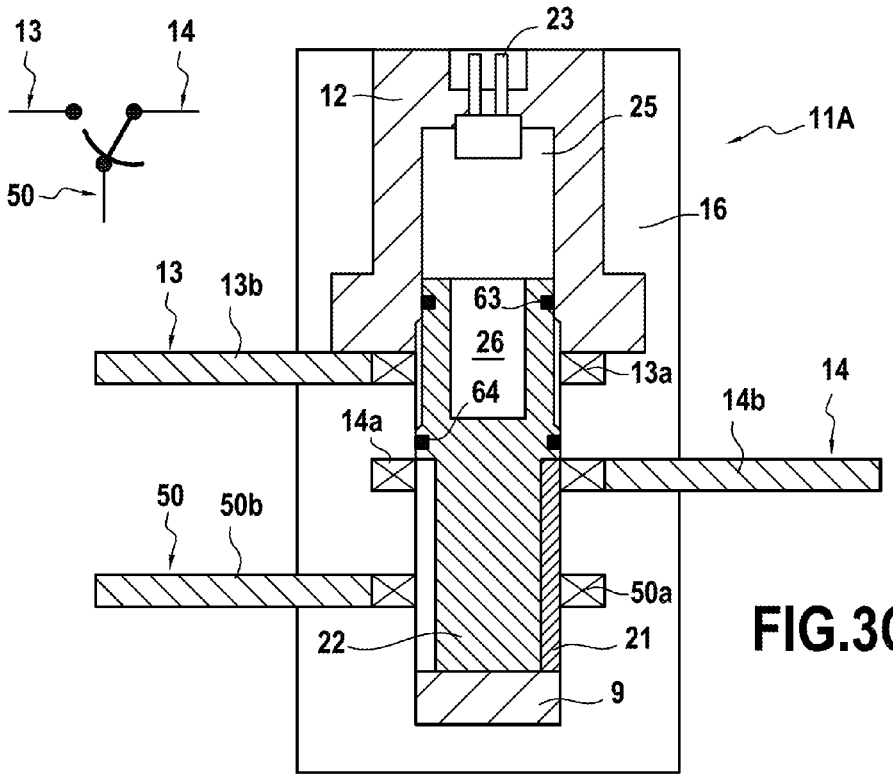

With reference more particularly to FIGS. 3A to 3C, it may be observed that the electric switch 11A that forms both a circuit breaker and a changeover switch is obtained in simple manner using the same modules as those described above.

More particularly, when the sliding assembly 20 is in the first or "initial" position, the situation from an electrical point of view is as shown in FIG. 3A, i.e. the two primary electrical conductive tabs 13 and 14 are interconnected by the split tube 21, as in the above example.

Nevertheless, in addition to the two primary conductive tabs 13 and 14, the electric switch 11A includes a secondary electrically conductive tab 50 situated downstream from the downstream primary conductive tab 14, also having a ring 50*a* that is extended on one side by a conductive bar 50*b* that projects outside the body of the switch.

When the sliding assembly is in its first position, the secondary conductive tab is disengaged from the split tube 21.

In contrast, when, after the pyrotechnic gas generator 23 has been triggered, the sliding assembly 20 is to be found in its second position (FIG. 3C), the downstream primary electrically conductive tab 14 is electrically connected to said secondary electrically conductive tab 50 by the split ring 21, while the upstream primary electrically conductive tab 13 is separated from the conductive split tube 21. The length of the split tube 21 is such that, for a short instant, during the stroke of the sliding assembly 20, all three tabs 13, 14, and 50 are electrically interconnected by the split tube 21. This is the situation shown in FIG. 3B. Thus, a branch circuit can be closed prior to the circuit breaker opening.

Figure 4A:
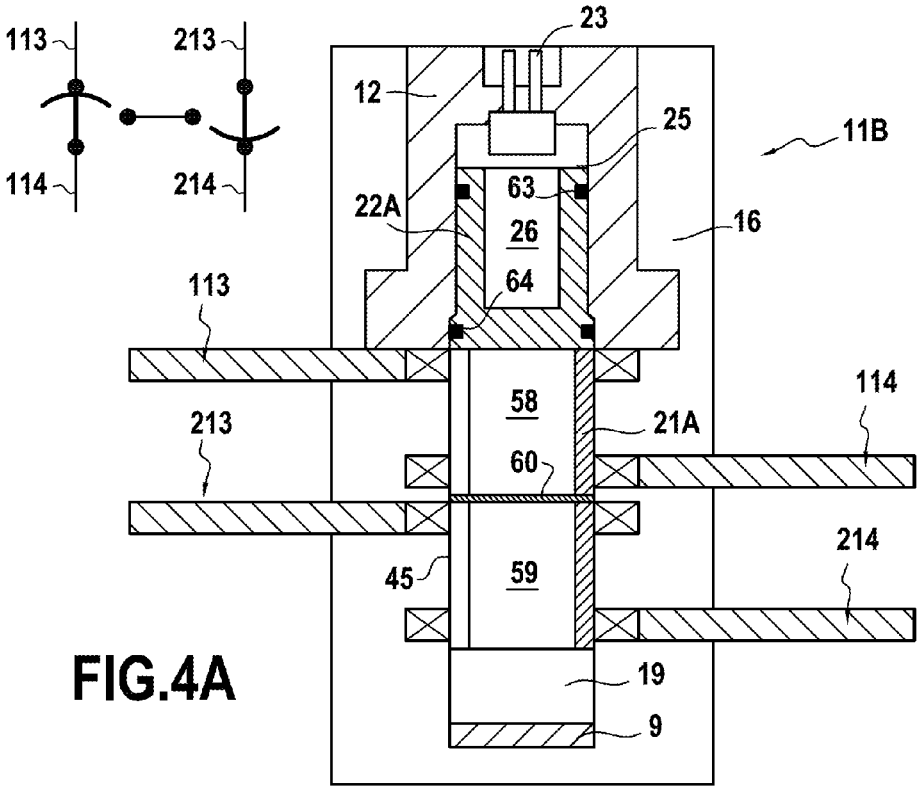

FIGS. 4A to 4C show another embodiment of a switch 11B that may be made using components that are generally similar to those shown in FIG. 2 and in which several groups of pairs of primary conductive tabs that are arranged in line with one another from upstream to downstream can all be associated with a single sliding assembly. In the example, only two groups of such pairs of primary conductive tabs are shown, but it is clear that the device could be "extended" in modular manner to have a larger number of groups of such tabs.

There can be seen a hollow body 16 of electrically insulating material defining a cavity 19 that is axially longer than in the above-described embodiments, and a pyrotechnic actuator 23 mounted at one end of the hollow body to define a gas expansion chamber 25 in association with the adjacent end of the piston 22A.

The piston 22A, which is shown in greater detail in FIG. 5, in this example is different in shape from the piston of the above-described embodiment, in that it is not extended by an additional guide portion for penetrating into the split tube. In other words, in this example, the split tube 21A is dissociated from a movable piston 22A inside the cavity 19. The piston 22A is then interposed between the split tube 21A and the pyrotechnic gas generator, the expansion chamber 25 being defined between the piston 22A and the actuator 23.

The piston 22A, which comprises a single portion 41 of diameter suitable for sliding along the cavity 19, thus urges the split tube 21A in an axial direction only for the purpose of moving it from the first position to the second position.

In this example, there can be seen a first group of two primary conductive tabs 113 and 114 and a second group of two primary conductive tabs 213 and 214, and the split tube has a corresponding number, i.e. two in this example, of conductive portions 58 and 59 that are electrically insulated from each other. In this example, the split tube 21A has two metal portions that are separated by an insulating portion 60 that extends in the initial position between the two groups of pairs of primary conductive tabs. In this way, each of said conductive portions 58, 59 interconnects only the conductive tabs of each of the groups while the sliding assembly is in its initial position, as shown in FIG. 4A. After the pyrotechnic gas generator has been actuated, the situation is that shown in FIG. 4C, i.e. the split tube 21 is completely disengaged from the upstream primary conductive tab 113 of the first group (the upstream group), the downstream primary conductive tab 114 of the first group is in contact with the upstream primary conductive tab 213 of the second group via the upstream split tube 58, while the downstream primary conductive tab 214 of the (downstream) second group is in electrical contact with the downstream portion of the split tube 59 but is electrically insulated from all of the other conductive tabs because the insulating portion 60 lies between the two primary conductive tabs of the (downstream) second group. Thus, in this arrangement, a changeover function is performed between the two groups of primary conductive tabs, i.e. the upstream primary conductive tab 213 of the second group acts as a secondary conductive tab relative to the first group.

As can be seen in the drawings, said two conductive portions of the split tube 21A are separated by insulation 60 of thickness that is smaller than the thickness of a conductive tab, and in particular of the upstream conductive tab 213 of the second group. Thus, and as shown in FIG. 4B, while the sliding assembly is moving, and because contact between the upstream portion of the split tube 21A and the upstream conductive tab of the first group has not yet been broken, all of the conductive tabs of the two groups are interconnected for a short time interval via the split tube.

In all of the embodiments, a passage of small section may advantageously be provided between the cavity 19 and the outside through the body 16 in order to facilitate moving the sliding assembly 20.

In addition, the combustion products from the gas generator may be conductive or may contain metal particles. If the circuit for breaking is under high voltage, an electric arc or metal plating may occur inside the chamber 25 after the piston 22 has moved. The piston 22 is thus advantageously made of an insulating material so that after actuation the two rings 13*a* and 14*a* are separated by an insulating portion.

The invention claimed is:

1. An electric switch, comprising:

a hollow body defining a cavity;

a sliding assembly comprising at least one conductive portion and adapted to move in said cavity from an initial first position to a second position;

an actuator arranged to co-operate with said sliding assembly and to move it in said cavity; and at least two primary electrically conductive tabs, respectively an upstream tab and a downstream tab, each comprising a ring penetrating into said cavity, said rings being on the same axis and being offset axially in a travel direction of the sliding assembly;

wherein the conductive portion of the sliding assembly is connected by a clamping force to the at least two primary electrically conductive tabs when the sliding assembly is in its first position, and when the sliding assembly is in its second position, the upstream electrically conductive tab is separated from the conductive portion of said sliding assembly;

and wherein the sliding assembly comprises at least one tube split by a slot extending along its entire length, and in that the conductive portion of the sliding assembly is constituted by all or part of said split tube, the clamping force between the conductive portion and the at least two primary electrically conductive tabs being provided by the resilience of the split tube.

2. An electric switch according to claim 1, wherein the slot extends in the axial direction of the tube.

3. An electric switch according to claim 1, wherein the sliding assembly includes a clamping element inserted inside the split tube and configured to apply an outwardly directed radial clamping force on said tube towards the electrically conductive tabs.

4. An electric switch according to claim 1, wherein the actuator is a pyrotechnic gas generator and the sliding assembly further includes a piston movable inside said cavity, a gas expansion chamber being defined between said pyrotechnic gas generator and said piston.

5. An electric switch according to claim 4, wherein the piston includes at least one circumferential groove adapted to receive a sealing ring.

6. An electric switch according to claim 4, wherein the piston is made of insulating material and comprises a first portion adapted to slide along the cavity, and a second portion that is situated in line with the first portion and that is suitable for being inserted, at least in part, inside the split tube in order to constitute a guide element for said tube.

7. An electric switch according to claim 6, wherein the second portion is mounted by force inside the split tube.

8. An electric switch according to claim 4, wherein the piston presents a cavity that is axially open upstream, the space defined by said cavity constituting at least a portion of the gas expansion chamber.

9. An electric switch according to claim 1, including at least one secondary electrically conductive tab arranged downstream from said at least two primary electrically conductive tabs, and wherein a stroke of the sliding assembly is such that when it is in said second position, one of said at least two primary electrically conductive tabs is electrically connected to said secondary electrically conductive tab by said conductive portion of the sliding assembly.

10. An electric switch according to claim 9, wherein the arrangement of the sliding assembly and of the primary and secondary electrical conductive tabs is such that in an intermediate position of said sliding assembly, said primary and secondary electrically conductive tabs are electrically interconnected by said conductive portion of said sliding assembly.

11. An electric switch according to claim 1, including at least two groups of said at least two primary electrically conductive tabs arranged in line one with another from upstream to downstream and wherein said sliding assembly includes a corresponding number of conductive portions that are mutually electrically insulated, each of said conductive portions interconnecting only the conductive tabs of each group when said sliding assembly is in its initial position.

12. An electric switch according to claim 11, wherein the arrangement of said sliding assembly and of the electrically conductive tabs of the at least two groups is such that for an intermediate position of said sliding assembly, the electrically conductive tabs of the at least two groups are electrically interconnected via said conductive portions.

13. An electric switch according to claim 12, wherein said conductive portions are separated by insulation of thickness smaller than the thickness of one of said primary electrically conductive tabs.

* * * * *